US010221560B2

(12) United States Patent
Köster

(10) Patent No.: US 10,221,560 B2
(45) Date of Patent: Mar. 5, 2019

(54) METHOD FOR PRODUCING WATER-SEALED SURFACES FROM CEMENT-BASED MATERIALS

(71) Applicant: Köster Bauchemie AG, Aurich (DE)

(72) Inventor: Johann J. Köster, Loga (DE)

(73) Assignee: KÖSTER BAUCHEMIE AG, Aurich (DE)

( * ) Notice: Subject to any disclaimer, the term of this patent is extended or adjusted under 35 U.S.C. 154(b) by 37 days.

(21) Appl. No.: 15/506,711

(22) PCT Filed: Jul. 30, 2015

(86) PCT No.: PCT/DE2015/100321
§ 371 (c)(1),
(2) Date: Feb. 24, 2017

(87) PCT Pub. No.: WO2016/029900
PCT Pub. Date: Mar. 3, 2016

(65) Prior Publication Data

US 2018/0223523 A1 Aug. 9, 2018

(30) Foreign Application Priority Data

Aug. 26, 2014 (DE) ..... 10 2014 112 159

(51) Int. Cl.
*E04B 1/68* (2006.01)
*E04B 1/66* (2006.01)
(Continued)

(52) U.S. Cl.
CPC ..... *E04B 1/665* (2013.01); *E04B 2/86* (2013.01); *E04B 5/32* (2013.01); *E21D 11/383* (2013.01); *E04B 2103/02* (2013.01)

(58) Field of Classification Search
CPC ..... E04B 1/66; E04B 1/665; E04B 2103/02; E04B 2/86; E04B 9/244; E04F 21/00
See application file for complete search history.

(56) References Cited

U.S. PATENT DOCUMENTS 1,654,030 A * 12/1927 Ashenhurst ..... E04B 1/82 181/284
3,867,800 A * 2/1975 Elliott ..... E04B 1/66 52/347

(Continued)

FOREIGN PATENT DOCUMENTS

GB 2340070 A * 2/2000 ..... B28B 19/0046
WO WO-2016059357 A1 * 4/2016 ..... E04B 2/86

*Primary Examiner* — Babajide A Demuren
(74) *Attorney, Agent, or Firm* — Jonathan M. D'Silva; MMI Intellectual Property

(57) ABSTRACT

A method for lateral-migration-preventing production of wall surfaces made of cement-based materials and sealed against water, more particularly of walls, of structures made of reinforced concrete, comprising: erecting an outer shuttering, applying a sealing material preferably to the full area of the inside of the outer shuttering, arranging a reinforcement in front of the inside of the outer shuttering that has been provided with the sealing material, applying an adhesion promoter to the sealing material through the reinforcement, erecting an inner shuttering, filling a cement-based material into the shuttering cavity formed by the outer and the inner shuttering, and hardening the material to form a solid bond between the cement-based material and the adhesion promoter located on the sealing material, a method for lateral-migration-preventing production of floor surfaces or surfaces made of cement-based materials and sealed against water, more particularly of floors and overhead surfaces of structures made of reinforced concrete.

26 Claims, 2 Drawing Sheets

Figure 1:
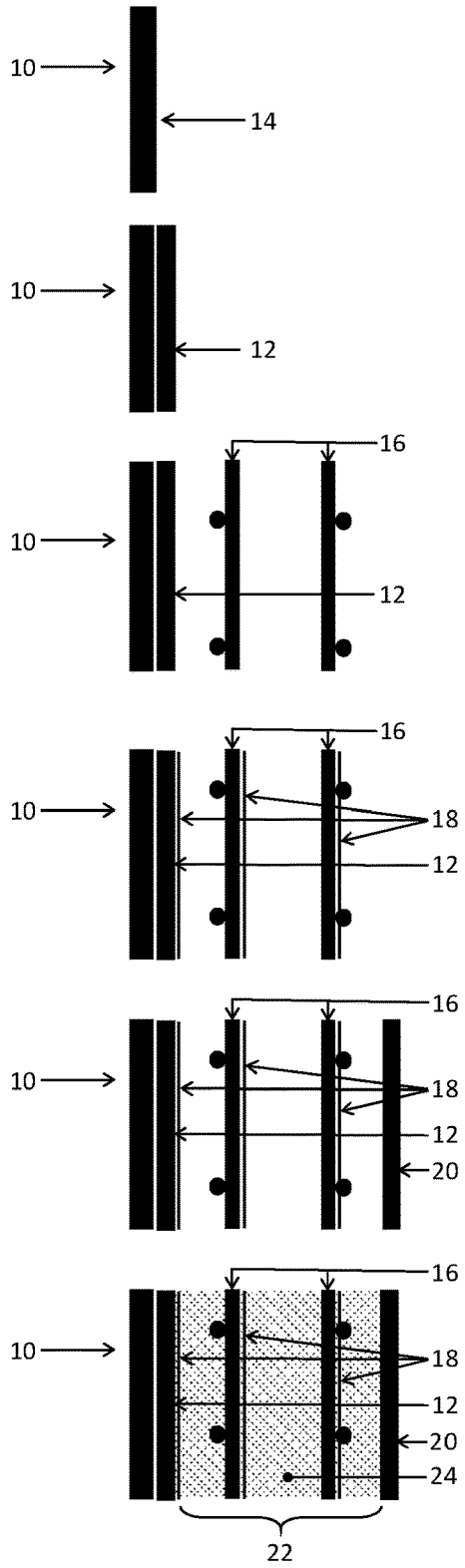

(51) Int. Cl.

| | |
|---|---|
| ***E21D 11/38*** | (2006.01) |
| ***E04B 2/86*** | (2006.01) |
| ***E04B 5/32*** | (2006.01) |

(56) References Cited

U.S. PATENT DOCUMENTS

| | | | | |
|---|---|---|---|---|
| 4,994,328 | A * | 2/1991 | Cogliano | C09J 7/026 156/71 |
| 2012/0198787 | A1* | 8/2012 | Mo | E04B 1/66 52/741.4 |
| 2016/0265220 | A1* | 9/2016 | Johnson | E04F 13/04 |
| 2017/0152659 | A1* | 6/2017 | Harvey | E04C 2/34 |
| 2017/0226734 | A1* | 8/2017 | Miks | E04B 2/562 |

* cited by examiner

METHOD FOR PRODUCING WATER-SEALED SURFACES FROM CEMENT-BASED MATERIALS

The present invention relates to a method for producing wall surfaces made of cement-based materials and sealed against water, more particularly of walls of structures made of reinforced concrete, to a method for producing floor surfaces made of cement-based materials and sealed against water, more particularly of floors of structures made of reinforced concrete, and also to a method for producing surfaces made of cement-based materials and sealed against water, more particularly of overhead surfaces. The water may come into contact with the surfaces both directly and indirectly through, for example, soil which is loaded with the water.

There are known polymeric sealing membranes for sealing surfaces of concrete structures and concrete edifices, composed of an HDPE sealing membrane, a pressure-sensitive adhesive layer, a weathering-insensitive acrylic coating or a layer of bitumen, or a layer of a mixture of bitumen and polymer and a removable protective sheet. If the protective sheet is removed and subsequently fresh concrete is applied to the system, the hardening of the fresh concrete is accompanied by the development of a continuous solid bond (an adhesive bond) between the adhesive layer and the concrete, intended durably to prevent lateral migration of water through the system. Since the protective sheet has to be removed at a very early stage in the erection of the concrete structure, given that later removal is no longer possible because of the reinforcement that has been applied, the adhesion-promoter effect of the adhesive layer with the additional weathering-insensitive coating is impaired, since the layer may be soiled and damaged in the period thereafter.

Additionally on the market are systems with which a polymeric sealing membrane, by means of composite plies (adhered or laminated-on nonwovens or fabrics) facing the concrete side, are intended to ensure subsequent prevention of lateral migration. In contact with the fresh concrete, then, a part of the cement paste will enter into a bond with the nonwoven fabric in order thus to guarantee sealing. Even here, however, there is possibility for soiling and, depending on time period, for algal infestation of the nonwovens—for example—in the ongoing course of construction. Accordingly there is no longer a homogeneous bond to the seal.

It is therefore an object of the present invention to provide a form of surface sealing with protection from lateral migration that can be applied in an uncomplicated way not until a short time before, for example, concreting takes place.

In accordance with the invention, this object is achieved, according to a first aspect, by a method for lateral-migration-preventing production of wall surfaces made of cement-based materials and sealed against water, more particularly of walls of structures made of reinforced concrete, comprising: erecting an outer shuttering, applying a sealing material preferably to the full area of the inside of the outer shuttering, arranging a reinforcement in front of the inside of the outer shuttering that has been provided with the sealing material, applying an adhesion promoter to the sealing material through the reinforcement, erecting an inner shuttering, filling a cement-based material into the shuttering cavity formed by the outer and the inner shuttering, and hardening the material to form a solid bond between the cement-based material and the adhesion promoter located on the sealing material. The cement-based material in the case of the method described herein is preferably unreinforced or reinforced concrete, such as steel-reinforced concrete or prestressed concrete, shotcrete, or else mortar or screed. The wall surfaces may be either vertical or else extend at an angle≠0 to the vertical.

According to a second aspect, this object is achieved, in accordance with the invention, by a method for lateral-migration-preventing production of floor surfaces made of cement-based materials and sealed against water, more particularly of floors of structures made of reinforced concrete, comprising: applying a sealing material preferably to the full area of a load-bearing substrate, more particularly a blinding layer, preferably made of unreinforced concrete, arranging a reinforcement above the layer of the sealing material, applying an adhesion promoter to the sealing material through the reinforcement, incorporating, for example pouring, a cement-based material from above into a shuttering erected before or after the arrangement of the reinforcement (28) around the substrate, and hardening the material to form a solid bond between the cement-based material—concrete, for example—and the adhesion promoter present on the sealing material The filling or pouring of a cement-based material is also referred to as incorporating. The substrate may, for example, also be a wooden underlayer or consolidated hardcore. The floor surfaces may extend either horizontally or at an angle≠0 to the horizontal.

According to a third aspect, this object is achieved by a method for lateral-migration-preventing production of surfaces made of cement-based materials and sealed against water, more particularly of overhead surfaces, e.g., ceilings, vaults, etc., of structures made of reinforced concrete, by applying a sealing material preferably to the full area of a substrate, more particularly a leveling layer, preferably made of shotcrete, arranging a reinforcement over the layer of the sealing material, applying an adhesion promoter to the sealing material through the reinforcement, incorporating, e.g. "spraying" a cement-based material from below onto the adhesion promoter, and hardening the material to form a solid bond between the cement-based material and the adhesion promoter located on the sealing material.

The shuttering comprises an encircling shuttering (edge shuttering) as boundary of the substrate or of the floor surface. The edge shuttering may be made either before or after the reinforcement has been installed. In a typical construction sequence, however, it is erected first, and only then is the reinforcement laid. In this case, the sealing normally continues under the shuttering or is raised on the inside of the shuttering.

According to one particular embodiment of the aforementioned methods, the sealing material is applied preferably in the form of sealing membranes, which are preferably laid overlappingly and are adhesively bonded or welded, for example, in the seam region.

The sealing material is based advantageously on FPO, TPE, ECB, PVC, EPDM, EVA, PE or the like.

The adhesion promoter is usefully applied by spraying. The adhesion promoter is advantageously a polymer-based dispersion, emulsion, suspension or solution based on acrylate, bitumen, cements or other substances.

According to a further particular embodiment of the present invention, the sealing material surface is preferably cleaned to remove soiling, preferably by means of a liquid, more particularly water, before the adhesion promoter is applied. As and when necessary, the excess or remaining liquid can also be removed actively, by being pumped off, for example, after cleaning has taken place.

The present invention is founded on the surprising realization that by the relatively late application of the adhesion promoter, it is in principle not damaged before the concrete is installed, and it therefore retains its adhesion promoter effect. This makes it possible in turn for an effective, durable surface bond to be produced with the fresh concrete as it hardens, and allows lateral migration through the surface seal to be prevented in the event of unwanted damage. Expressed alternatively, the "adhesive layer" stated above for the prior art, in the form of the adhesion promoter, is applied as late as possible. Application may take place, for example, by sprayed application of a specific adhesion promoter. In one particular embodiment at least, the specific adhesion promotor ought to bond well to the (already laid) sealing membrane and also, later, to the fresh concrete, so that there is a bond between the cement-based material and the adhesion promoter located on the sealing material.

When the specific adhesion promoter is applied, regions of the reinforcement are also wetted as well. This wetting has no detrimental effect on either the function or the lifetime of the reinforcement.

Figure 2:
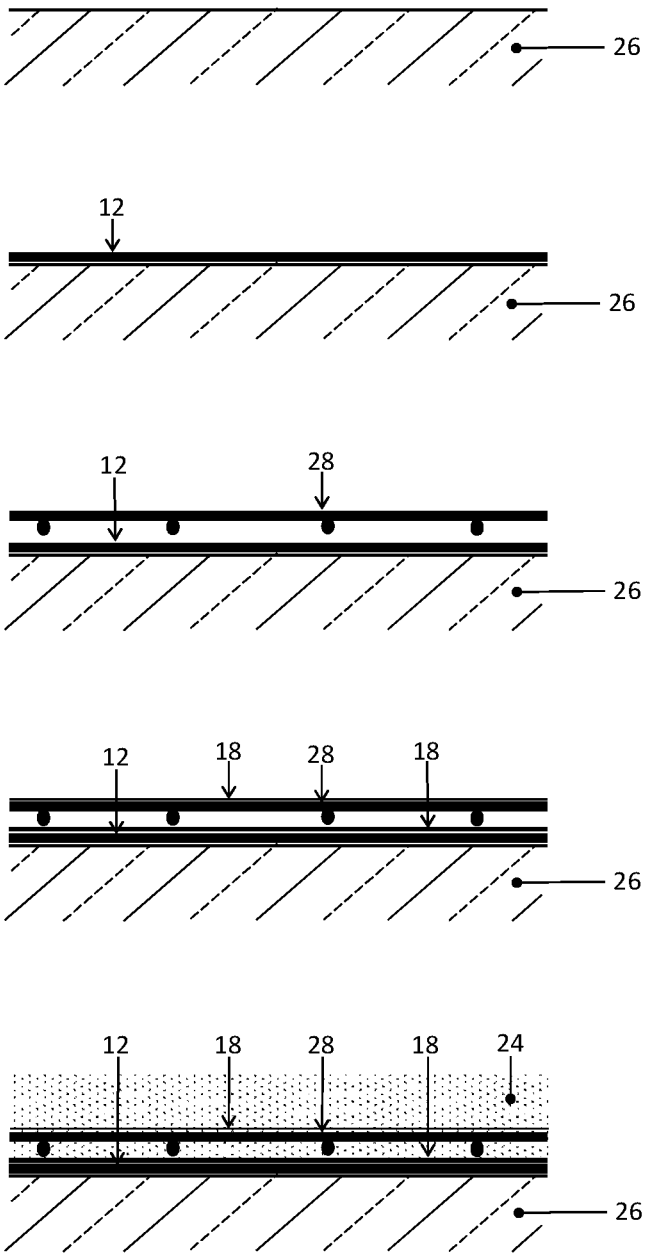

Further advantages and features of the invention will emerge from the appended claims and the subsequent description, which elucidates two exemplary embodiments in detail, using the diagrammatic drawings, in which:

FIG. 1 shows stages of a method according to a first particular embodiment of the present invention; and FIG. 2 shows stages of a method according to a further particular embodiment of the present invention.

FIG. 1 shows, from top to bottom, a sequence of steps in a method for producing wall surfaces made of cement-based materials and sealed against water, according to one particular embodiment of the present invention, it being possible for further method steps to take place between those shown. First of all an outer shuttering 10 is erected, on a substrate (not shown in FIG. 1). Then a sealing material 12 in the form of sealing membranes is applied over the full area of the inside 14 of the outer shuttering. More specifically, in this example, the sealing membranes are laid overlappingly and are welded, for example, in the seam region. The sealing material may be FPO, for example.

Subsequently a reinforcement 16 is arranged in front of the inside 14 of the outer shuttering 10 that has been provided with the sealing material 12.

In a further step, an adhesion promoter dispersion 18, with an acrylic basis, for example, is sprayed through the reinforcement 16 onto the sealing material 12. Normally here it is not possible to prevent the reinforcement 16 as well being at least partially coated with the adhesion promotor dispersion 18.

Thereafter an inner shuttering 20 is erected on the substrate.

Concrete 24 is then filled into the resulting shuttering cavity 22 and hardened to form a solid bond between the concrete 24 and the adhesion promoter dispersion 18 located on the sealing material 12.

FIG. 2 shows a particular embodiment of a method for producing floor surfaces made of cement-based materials and sealed against water, at different stages (from top to bottom). This is a sequence of method steps, which need not indirectly immediately follow one another.

In the present exemplary embodiment, the substrate 26 consists of a blinding layer of unreinforced concrete which is applied over the full area. Arranged on the substrate 26 is a sealing material 12 in the form of sealing membranes, the sealing membranes being laid overlappingly and adhesively bonded, for example, in the seam region. The sealing material 12 may be based on TPE, for example.

Then a reinforcement 28 is arranged above the layer of the sealing material 12, after which an adhesion promoter dispersion 18, based on acrylate, for example, is normally applied by spraying through the reinforcement 28, in which case the reinforcement 28 as well is at least partly coated with the adhesion promoter dispersion 18.

Thereafter, concrete 24 is poured from above onto the reinforcement 28, and the concrete is hardened to form a solid bond between the concrete 24 and the adhesion promoter dispersion 18 located on the sealing material 12. An encircling shuttering (not shown) may have been erected before or after the application of the reinforcement 28.

If overhead surfaces are to be sealed, this may be done, for example, by adhesively bonding sealing webs to the substrate (ceiling or vaulted ceiling, for example) and plugging on a reinforcement with spacers.

The features of the invention that are disclosed in the present description, in the drawings, and in the claims may be essential, both individually and in any desired combinations, for the actualization of the invention in its various embodiments.

The invention claimed is:

1. A method for lateral-migration-preventing production of wall surfaces made of cement-based materials and sealed against water, comprising:

erecting an outer shuttering (10), applying a sealing material (12) to the inside of the outer shuttering (10), arranging a reinforcement (16) in front of the inside (14) of the outer shuttering (10) that has been provided with the sealing material (12), applying an adhesion promoter (18) to the sealing material (12) through the reinforcement (16), erecting an inner shuttering (20), filling a cement-based material into a shuttering cavity (22) formed by the outer (10) and the inner (20) shuttering, and hardening the material to form a solid bond between the cement-based material and the adhesion promoter (18) located on the sealing material (12).

2. A method for lateral-migration-preventing production of floor surfaces made of cement-based materials and sealed against water, comprising:

applying a sealing material (12) to a substrate (26), wherein said sealing material (12) forms a blinding layer, arranging a reinforcement (28) above the layer of the sealing material (12), applying an adhesion promoter (18) to the sealing material (12) through the reinforcement (28), incorporating a cement-based material from above into a shuttering erected before or after the arrangement of the reinforcement (28) around the substrate, and hardening the material to form a solid bond between the cement-based material and the adhesion promoter located on the sealing material (12).

3. A method for lateral-migration-preventing production of overhead surfaces made of cement-based materials and sealed against water, comprising:

applying a sealing material to a substrate, wherein said sealing material forms a leveling layer, arranging a reinforcement over the layer of the sealing material, applying an adhesion promoter to the sealing material through the reinforcement, incorporating, a cement-based material from below onto the adhesion promoter, and hardening the material to form a solid bond between the cement-based material and the adhesion promoter located on the sealing material.

4. The method of claim 1 characterized in that the sealing material (12) is applied in the form of sealing membranes which are laid overlappingly and are adhesively bonded or welded in the seam region.

5. The method of claim 1 characterized in that the sealing material (12) is based on FPO, TPE, ECB, PVC, EPDM, EVA, or PE.

6. The method of claim 1 characterized in that the adhesion promoter (18) is applied by spraying.

7. The method of claim 1 characterized in that the adhesion promoter (18) is a polymer-based dispersion, emulsion, suspension or solution based on acrylate, bitumen, cements or other substances.

8. The method of claim 1 characterized in that before the adhesion promoter (18) is applied, the surface of the sealing material (12) is cleaned to remove soiling, by means of a liquid.

9. The method of claim 2 characterized in that the sealing material (12) is applied in the form of sealing membranes which are laid overlappingly and are adhesively bonded or welded in the seam region.

10. The method of claim 2 characterized in that the sealing material (12) is based on FPO, TPE, ECB, PVC, EPDM, EVA, or PE.

11. The method of claim 2 characterized in that the adhesion promoter (18) is applied by spraying.

12. The method of claim 2 characterized in that the adhesion promoter (18) is a polymer-based dispersion, emulsion, suspension or solution based on acrylate, bitumen, cements or other substances.

13. The method of claim 2 characterized in that before the adhesion promoter (18) is applied, the surface of the sealing material (12) is cleaned to remove soiling, by means of a liquid.

14. The method of claim 3 characterized in that the sealing material (12) is applied in the form of sealing membranes which are laid overlappingly and are adhesively bonded or welded in the seam region.

15. The method of claim 3 characterized in that the sealing material (12) is based on FPO, TPE, ECB, PVC, EPDM, EVA, or PE.

16. The method of claim 3 characterized in that the adhesion promoter (18) is applied by spraying.

17. The method of claim 3 characterized in that the adhesion promoter (18) is a polymer-based dispersion, emulsion, suspension or solution based on acrylate, bitumen, cements or other substances.

18. The method of claim 3 characterized in that before the adhesion promoter (18) is applied, the surface of the sealing material (12) is cleaned to remove soiling, by means of a liquid.

19. The method of claim 1 characterized in that before the adhesion promoter (18) is applied, the surface of the sealing material (12) is cleaned with water to remove soiling.

20. The method of claim 2 characterized in that before the adhesion promoter (18) is applied, the surface of the sealing material (12) is cleaned with water to remove soiling.

21. The method of claim 3 characterized in that before the adhesion promoter (18) is applied, the surface of the sealing material (12) is cleaned with water to remove soiling.

22. The method of claim 2 in which said sealing material is unreinforced concrete.

23. The method of claim 3 in which said sealing material is shotcrete.

24. The method of claim 1 in which the wall surfaces are structures made of reinforced concrete.

25. The method of claim 2 in which the floor surfaces are structure are made of reinforced concrete.

26. The method of claim 3 in which the overhead surfaces are structures made of reinforced concrete.

* * * * *